US009169841B2

(12) United States Patent
Bonnefoi et al.

(10) Patent No.: US 9,169,841 B2
(45) Date of Patent: Oct. 27, 2015

(54) SCROLL COMPRESSOR HAVING FIRST AND SECOND OLDHAM COUPLINGS

(71) Applicant: DANFOSS COMMERCIAL COMPRESSORS, Reyrieux, Trevoux (FR)

(72) Inventors: Patrice Bonnefoi, Saint Didier au Mont d'Or (FR); Yves Rosson, Villars les Dombes (FR); Ingrid Claudin, Villars les Dombes (FR)

(73) Assignee: DANFOSS COMMERCIAL COMPRESSORS, Reyrieux (FR)

( * ) Notice: Subject to any disclaimer, the term of this patent is extended or adjusted under 35 U.S.C. 154(b) by 142 days.

(21) Appl. No.: 14/138,503

(22) Filed: Dec. 23, 2013

(65) Prior Publication Data

US 2014/0178229 A1 Jun. 26, 2014

(30) Foreign Application Priority Data

Dec. 21, 2012 (FR) ..... 12 62567

(51) Int. Cl.

| | |
|---|---|
| ***F16D 3/04*** | (2006.01) |
| ***F01C 1/02*** | (2006.01) |
| ***F04C 29/00*** | (2006.01) |
| ***F04C 18/02*** | (2006.01) |

(52) U.S. Cl.

CPC ..... *F04C 29/0057* (2013.01); *F04C 18/0207* (2013.01); *F04C 18/0215* (2013.01); *F04C 29/0021* (2013.01)

(58) Field of Classification Search

CPC ..... F04C 2/1078; F04C 29/0057; F04C 18/0207; F01C 17/066

USPC ..... 418/55.5, 55.3; 464/102

See application file for complete search history.

(56) References Cited

U.S. PATENT DOCUMENTS

| | | | | |
|---|---|---|---|---|
| 4,332,535 | A * | 6/1982 | Terauchi et al. | 418/55.6 |
| 5,080,566 | A * | 1/1992 | Sakata et al. | 418/55.3 |
| 5,141,417 | A * | 8/1992 | Bush | 418/1 |
| 5,141,421 | A | 8/1992 | Bush et al. | |
| 5,531,577 | A * | 7/1996 | Hayase et al. | 418/55.1 |

(Continued)

FOREIGN PATENT DOCUMENTS

FR 2 780 108 A1 12/1999

OTHER PUBLICATIONS

Sep. 3, 2013 Search Report issued in French Application No. 1262567 (with translation).

*Primary Examiner* — Mary A Davis
*Assistant Examiner* — Anthony Ayala Delgado
(74) *Attorney, Agent, or Firm* — Oliff PLC

(57) ABSTRACT

This scroll compressor includes a first fixed scroll member, an orbiting scroll arrangement including a first orbiting scroll member, a first Oldham coupling provided between the first orbiting scroll member and the first fixed scroll member and configured to prevent rotation of the first orbiting scroll member with respect to the first fixed scroll member, a fixed element opposite to the first fixed scroll member with respect to the orbiting scroll arrangement, and a second Oldham coupling provided between the orbiting scroll arrangement and the fixed element and configured to prevent rotation of the orbiting scroll arrangement with respect to the fixed element. The first Oldham coupling is slidable with respect to the first fixed scroll member along a first displacement direction, and the second Oldham coupling is slidable with respect to the fixed element along a second displacement direction transverse to the first displacement direction.

16 Claims, 4 Drawing Sheets

(56) References Cited

U.S. PATENT DOCUMENTS 5,775,893 A 7/1998 Takao et al.
6,776,593 B1 * 8/2004 Cho ..... 418/55.3
7,918,658 B2 * 4/2011 Bush et al. ..... 418/55.3
8,303,280 B2 * 11/2012 Kiyokawa et al. ..... 418/55.3
2011/0081264 A1 * 4/2011 Ishizono et al. ..... 417/410.5
2013/0251568 A1 * 9/2013 Bush ..... 418/1

* cited by examiner

SCROLL COMPRESSOR HAVING FIRST AND SECOND OLDHAM COUPLINGS

FIELD OF THE INVENTION

The present invention relates to a scroll compressor, and in particular to a scroll refrigeration compressor.

BACKGROUND OF THE INVENTION

As known, a scroll compressor comprises:

a fixed scroll member comprising a fixed end plate and a fixed spiral wrap provided on one face of the fixed end plate, an orbiting scroll member comprising an orbiting end plate and an orbiting spiral wrap provided on one face of the orbiting end plate, the fixed spiral wrap and the orbiting spiral wrap forming a plurality of compression chambers, a support frame, also named crankcase, on which is slidably mounted the orbiting end plate of the orbiting scroll member, an Oldham coupling provided between the orbiting scroll member and the support frame, and configured to prevent rotation of the orbiting scroll member with respect to the support frame, the Oldham coupling being slidably mounted with respect to the support frame along a first displacement direction, a drive shaft adapted for driving the orbiting scroll member in an orbital movement, and an electric motor for driving in rotation the drive shaft about a rotation axis.

In order to reduce the compressor vibrations generated by the reciprocating translation movement of the Oldham coupling along the first displacement direction, the scroll compressor further comprises a rotating counterweight attached to the drive shaft.

However, the unbalance induced by the reciprocating translation movement of the Oldham coupling cannot be perfectly compensated thanks to a rotating counterweight, which leads to the presence of a residual unbalance, and thus of residual compressor vibrations. Such residual compressor vibrations may cause a damage of some parts of the scroll compressor, and may detract the efficiency of the scroll compressor.

SUMMARY OF THE INVENTION

It is an object of the present invention to provide an improved scroll compressor which can overcome the drawbacks encountered in conventional scroll compressors.

Another object of the present invention is to provide a scroll compressor which is reliable and which can be easily balanced.

According to the invention such a scroll compressor comprises:

a first fixed scroll member comprising a first fixed end plate and a first fixed spiral wrap provided on one face of the first fixed end plate, an orbiting scroll arrangement including at least a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a first Oldham coupling provided between the first orbiting scroll member and the first fixed scroll member, and configured to prevent rotation of the first orbiting scroll member with respect to the first fixed scroll member, the first Oldham coupling being slidable with respect to the first fixed scroll member along a first displacement direction, a second Oldham coupling configured to prevent rotation of the orbiting scroll arrangement with respect to the first fixed scroll member, the second Oldham coupling being slidable with respect to the first fixed scroll member along a second displacement direction, wherein the first and second displacement directions of the first and second Oldham couplings are substantially orthogonal with respect to each other.

Due to the transverse movements of the first and second Oldham couplings, the centers of gravity of the first and second Oldham couplings can be assimilated to a rotating mass, which can be easily balanced by a rotating counterweight attached to the drive shaft. Therefore, the compressor vibrations generated by the translation movements of the first and second Oldham couplings can be greatly reduced. Such a limitation of the compressor vibrations leads to an improvement of the compressor reliability and efficiency.

According to an embodiment of the invention, each of the first and second Oldham couplings undergoes a reciprocating motion respectively along the first and second displacement directions.

For example, the first and second displacement directions of said first and second Oldham couplings may be orthogonal with respect to each other, or may be inclined by an angle comprised between 80 and 100°, and preferably between 85 and 95°.

According to an embodiment of the invention, the first and second Oldham couplings are configured such that, in operation, the resulting center of gravity of the first and second Oldham couplings is moving along a circular trajectory.

According to an embodiment of the invention, the scroll compressor further comprises a drive shaft adapted for driving the orbiting scroll arrangement in an orbital movement, and a motor for driving in rotation the drive shaft about a rotation axis.

According to an embodiment of the invention, the first and second displacement directions are substantially perpendicular to the rotation axis of the drive shaft.

According to an embodiment of the invention, the center of the circular trajectory is substantially located on the rotation axis of the drive shaft. This arrangement of the first and second Oldham couplings allows to cancel the residual unbalance due to the first and second Oldham couplings movements, and thus to greatly improve the balance the compressor.

According to an embodiment of the invention, the first and second Oldham couplings are configured such that the middle-stroke positions of the centers of gravity of the first and second Oldham couplings are substantially located on the rotation axis of the drive shaft.

According to an embodiment of the invention, the scroll compressor further comprises a counterweight attached to the drive shaft and intended to balance the total mass of the first and second Oldham couplings.

According to an embodiment of the invention, the center of gravity of the counterweight is substantially diametrically opposed to the resulting center of gravity of the first and second Oldham couplings and of the orbiting scroll arrangement with respect to the rotation axis of the drive shaft.

According to an embodiment of the invention, the stroke length of the first Oldham coupling along the first displacement direction is substantially equal to the stroke length of the second Oldham coupling along the second displacement direction.

According to an embodiment of the invention, the first and second Oldham couplings respectively include first and second annular bodies that are substantially parallel to each other.

According to an embodiment of the invention, the first Oldham coupling includes:

a first annular body, a first pair of first engaging projections provided on a first side of the first annular body, the first engaging projections of the first Oldham coupling being slidably engaged in a first pair of first guiding grooves provided on the first fixed scroll member, said first guiding grooves being offset and extending substantially parallel to the first displacement direction, and a second pair of second engaging projections provided on a second side of the first annular body, the second engaging projections of the first Oldham coupling being slidably engaged in a second pair of second guiding grooves provided on the first orbiting scroll member, said second guiding grooves being offset and extending substantially perpendicularly to the first displacement direction.

According to an embodiment of the invention, the first annular body is disposed around the first fixed spiral wrap and the first orbiting spiral wrap.

According to an embodiment of the invention, the first engaging projections of the first Oldham coupling extend substantially perpendicularly from the first side of the first annular body and the second engaging projections of the first Oldham coupling extend substantially perpendicularly from the second side of the first annular body.

According to another embodiment of the invention, the first pair of first engaging projections may be provided on the first fixed scroll member, and the first pair of first guiding grooves may be provided on the first side of the first annular body.

According to another embodiment of the invention, the second pair of second engaging projections may be provided on the first orbiting scroll member, and the second pair of second guiding grooves may be provided on the second side of the first annular body.

Thus, for example, the first annular body may comprise the first pair of guiding grooves on its first side and the second pair of second guiding grooves on its second side. The first annular body may also comprise a pair of engaging projections on one of its first and second sides and a pair of guiding grooves on its other side.

According to an embodiment of the invention, the scroll compressor further comprises a fixed element opposite to the first fixed scroll member with respect to the orbiting scroll arrangement, the second Oldham coupling being provided between the orbiting scroll arrangement and the fixed element and configured to prevent rotation of the orbiting scroll arrangement with respect to the fixed element, the second Oldham coupling being slidable with respect to the fixed element along the second displacement direction.

According to an embodiment of the invention, the second Oldham coupling includes:

a second annular body, a first pair of first engaging projections provided on a first side of the second annular body, the first engaging projections of the second Oldham coupling being slidably engaged in a first pair of first guiding grooves provided on the fixed element, said first guiding grooves being offset and extending substantially parallel to the second displacement direction, and a second pair of second engaging projections provided on a second side of the second annular body, the second engaging projections of the second Oldham coupling being slidably engaged in a second pair of second guiding grooves provided on the orbiting scroll arrangement, said second guiding grooves being offset and extending substantially perpendicularly to the second displacement direction.

According to an embodiment of the invention, the first engaging projections of the second Oldham coupling extend substantially perpendicularly from the first side of the second annular body and the second engaging projections of the second Oldham coupling extend substantially perpendicularly from the second side of the second annular body.

According to another embodiment of the invention, the first pair of first engaging projections may be provided on the fixed element, and the first pair of first guiding grooves may be provided on the first side of the second annular body.

According to another embodiment of the invention, the second pair of second engaging projections may be provided on the orbiting scroll arrangement, and the second pair of second guiding grooves may be provided on the second side of the second annular body.

Thus, for example, the second annular body may comprise the first pair of guiding grooves on its first side and the second pair of second guiding grooves on its second side. The second annular body may also comprise a pair of engaging projections on one of its first and second sides and a pair of guiding grooves on its other side.

According to an embodiment of the invention, the fixed element is formed by a support frame on which is slidably mounted the first orbiting end plate of the first orbiting scroll member.

According to an embodiment of the invention, the scroll compressor further comprises a closed casing and a suction inlet, the closed casing and the support frame defining a low pressure volume into which opens the suction inlet.

According to an embodiment of the invention, the second Oldham coupling is provided between the support frame and the first orbiting end plate.

According to an embodiment of the invention, the second guiding grooves in which are slidably engaged the second engaging projections of the second Oldham coupling are provided on the first orbiting scroll member.

According to an embodiment of the invention, the fixed element is formed by a second fixed scroll member comprising a second fixed end plate and a second fixed spiral wrap provided on one face of the second fixed end plate, and the orbiting scroll arrangement further comprises a second orbiting scroll member comprising a second orbiting end plate and a second orbiting spiral wrap provided on one face of the second orbiting end plate, the second fixed spiral wrap and the second orbiting spiral wrap forming a plurality of second compression chambers, the second Oldham coupling being provided between the second orbiting scroll member and the second fixed scroll member, and particularly between the second orbiting end plate and the second fixed end plate.

According to an embodiment of the invention, the first and second orbiting scroll members are joined or linked together.

According to an embodiment of the invention, the first and second orbiting end plates are secured to each other.

According to an embodiment of the invention, the first and second orbiting end plates are formed by a common end plate, the first and second orbiting spiral wraps being provided on opposing faces of the common end plate.

According to an embodiment of the invention, the second annular body is disposed around the second fixed spiral wrap and the second orbiting spiral wrap.

The present invention also relates to a method of operating a scroll compressor, comprising the steps of:

providing the scroll compressor with:

a first fixed scroll member comprising a first fixed end plate and a first fixed spiral wrap provided on one face of the first fixed end plate, an orbiting scroll arrangement including at least a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a first Oldham coupling provided between the first orbiting scroll member and the first fixed scroll member, and configured to prevent rotation of the first orbiting scroll member with respect to the first fixed scroll member, the first Oldham coupling being slidable with respect to the first fixed scroll member along a first displacement direction, a second Oldham coupling configured to prevent rotation of the orbiting scroll arrangement with respect to the first fixed scroll member, the second Oldham coupling being slidable with respect to the first fixed scroll member along a second displacement direction, the second displacement direction of the second Oldham coupling being substantially orthogonal to the first displacement direction of the first Oldham coupling, and displacing the orbiting scroll arrangement along an orbital movement so as to displace the first and second Oldham couplings respectively along the first and second displacement directions.

According to an embodiment of the invention, the providing step further comprises providing the scroll compressor with:

a drive shaft adapted for driving the orbiting scroll arrangement in the orbital movement, and a motor for driving in rotation the drive shaft about a rotation axis, and the method further comprises the step of balancing the total mass of the first and second Oldham couplings with a counterweight attached to the drive shaft.

These and other advantages will become apparent upon reading the following description in view of the drawing attached hereto representing, as non-limiting examples, embodiments of a vehicle according to the invention.

BRIEF DESCRIPTION OF THE DRAWINGS

The following detailed description of two embodiments of the invention is better understood when read in conjunction with the appended drawings being understood, however, that the invention is not limited to the specific embodiments disclosed.

DETAILED DESCRIPTION OF THE INVENTION

Figure 1:
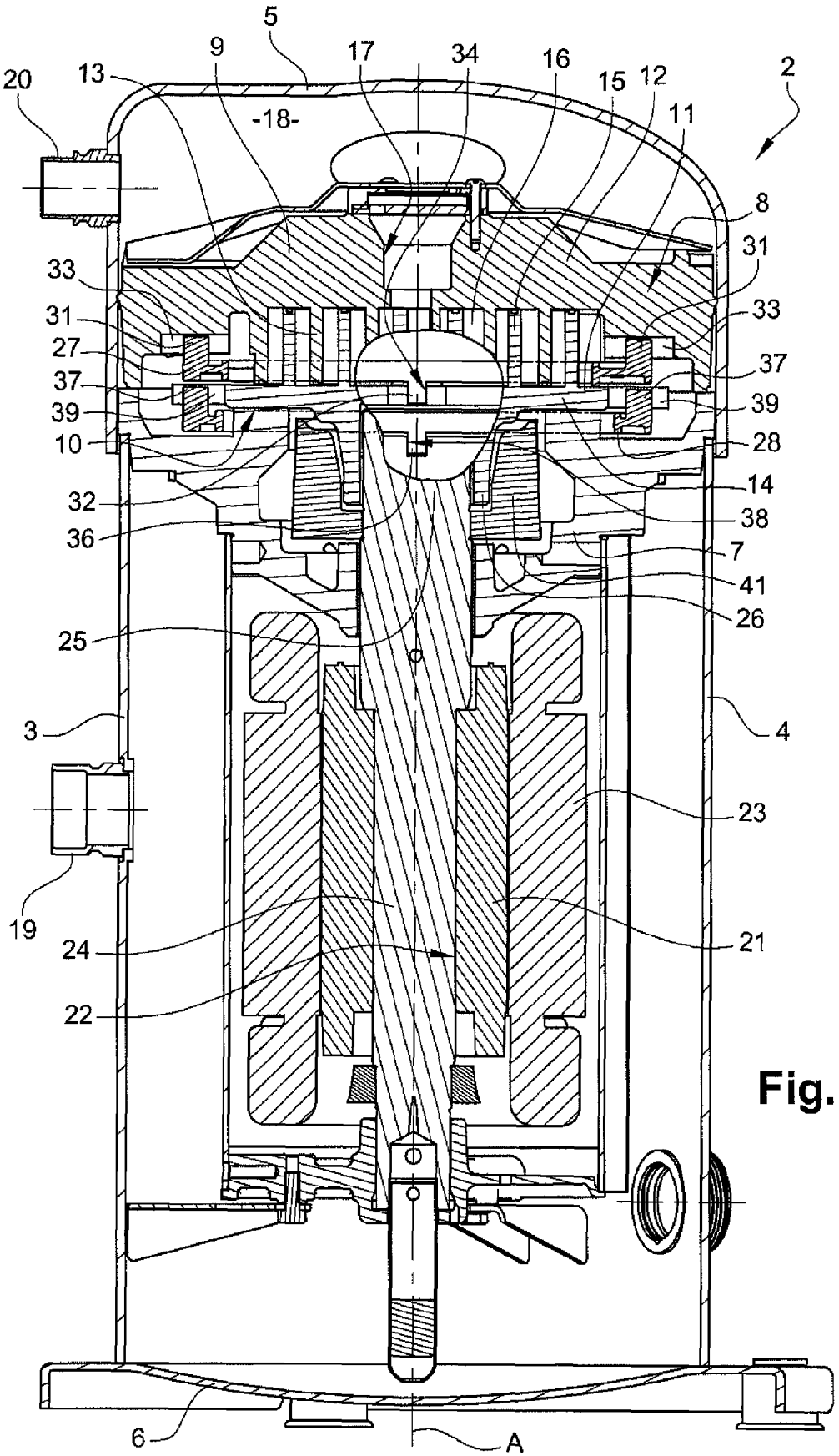
FIG. 1 is a longitudinal section view of a scroll compressor according to a first embodiment of the invention.

FIG. 1 shows a scroll refrigeration compressor 2 occupying a vertical position. However, the scroll refrigeration compressor 2 according to the invention could occupy an inclined position, or a horizontal position, without significant modification to its structure.

The scroll refrigeration compressor 2 shown in FIG. 1 comprises a closed housing 3 defined by a shell 4 whose top and bottom ends are respectively closed by cap 5 and a base 6.

The scroll refrigeration compressor 2 also comprises a support frame 7 fixed in the closed housing 3, the closed casing 3 and the support frame 7 defining a low pressure volume.

The scroll refrigeration compressor 2 further comprises a scroll compression unit 8 disposed above the support frame 7. The scroll compression unit 8 has a fixed scroll member 9 and an orbiting scroll arrangement 10. In particular the fixed scroll member 9 is fixed in relation to the closed housing 3, and the orbiting scroll arrangement 10 includes an orbiting scroll member 11 supported by and in slidable contact with an upper face of the support frame 7.

As known, the fixed scroll member 9 has an end plate 12 and a spiral wrap 13 projecting from the end plate 12 towards the orbiting scroll member 11, and the orbiting scroll member 11 has an end plate 14 and a spiral wrap 15 projecting from the end plate 14 towards the fixed scroll member 9. The spiral wrap 15 of the orbiting scroll member 11 meshes with the spiral wrap 13 of the fixed scroll member 9 to form a plurality of compression chambers 16 between them. The compression chambers 16 have a variable volume which decreases from the outside towards the inside, when the orbiting scroll member 11 is driven to orbit relative to the fixed scroll member 9. The end plate 12 of the fixed scroll member 9 includes, in its central part, a discharge aperture 17 opening into the central compression chambers 16 and leading to a high pressure discharge chamber 18.

The scroll refrigeration compressor 2 also includes a refrigerant suction inlet 19 opening into the low pressure volume to achieve the supply of refrigerant to the compressor, and a discharge outlet 20 which opens into the discharge chamber 18.

The refrigeration compressor 2 further comprises an electric motor disposed below the support frame 7. The electric motor has a rotor 21 provided with an axial through passage 22, and a stator 23 disposed around the rotor 21.

Furthermore the scroll refrigeration compressor 2 comprises a drive shaft 24 adapted for driving the orbiting scroll member 11 in an orbital movement. The drive shaft 24 extends into the axial through passage 22 of the rotor 21 and is rotatably coupled to the rotor 21, so that the drive shaft 24 is driven to rotate by the rotor 21 about a rotation axis A. The drive shaft 24 comprises, at its top end, an eccentric pin 25 which is off-centered from the center of the drive shaft 24, and which is inserted in a connecting sleeve part 26 of the orbiting scroll member 11.

The scroll refrigeration compressor 2 also comprises a first Oldham coupling 27 which is slidably mounted with respect to the fixed scroll member 9 along a first displacement direction D1, and a second Oldham coupling 28 which is slidably mounted with respect to the support frame 7 along a second displacement direction D2 which is substantially orthogonal to the first displacement direction D1. The first and second displacement directions D1, D2 are substantially perpendicular to the rotation axis A of the drive shaft 24. The first and second Oldham couplings 27, 28 are configured to prevent rotation of the orbiting scroll member 11 with respect to the fixed scroll member 9 and the support frame 7. Each of the first and second Oldham couplings 27, 28 undergoes a reciprocating motion respectively along the first and second displacement directions D1, D2.

The first Oldham coupling 27 includes an annular body 29 disposed between the end plates 12, 14 of the fixed and orbiting scroll members 9, 11, and around the spiral wraps 13, 15. The first Oldham coupling further includes a pair of first engaging projections 31 provided on a first side of the annular body 29, and a pair of second engaging projections 32 provided on a second side of the annular body 29. The first engaging projections 31 of the first Oldham coupling 27 are slidably engaged in a pair of first guiding grooves 33 provided on the end plate 12 of the fixed scroll member 9, the first guiding grooves 33 being offset and extending parallel to the first displacement direction D1. The second engaging projections 32 of the first Oldham coupling 27 are slidably engaged in a pair of second guiding grooves 34 provided on the end plate 14 of the orbiting scroll member 11, the second guiding grooves 34 being offset and extending parallel to the second displacement direction D2, i.e. perpendicularly to the first displacement direction D1.

Figure 2:
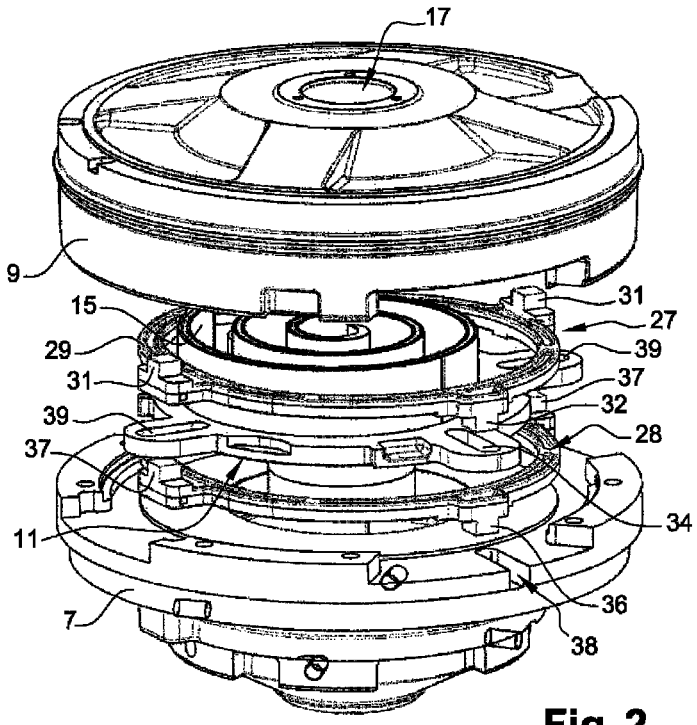
FIG. 2 is a partial exploded perspective view of the scroll compressor of FIG. 1.

According to the embodiment of the invention shown in FIG. 2, the first and second engaging projections 31, 32 extend respectively perpendicularly from the first and second sides of the annular body 29.

The second Oldham coupling 28 includes an annular body 35 disposed between the support frame 7 and the end plate 14 of the orbiting scroll member 11. The annular body 35 of the second Oldham coupling 28 extends substantially parallel to the annular body 29 of the first Oldham coupling 27.

The second Oldham coupling 28 further includes a pair of first engaging projections 36 provided on a first side of the annular body 35, and a pair of second engaging projections 37 provided on a second side of the annular body 35. The first engaging projections 36 of the second Oldham coupling 28 are slidably engaged in a pair of first guiding grooves 38 provided on the support frame 7, the first guiding grooves 38 being offset and extending parallel to the second displacement direction D2. The second engaging projections 37 of the second Oldham coupling 28 are slidably engaged in a pair of second guiding grooves 39 provided on the end plate 14 of the orbiting scroll member 11, the second guiding grooves 39 being offset and extending parallel to the first displacement direction D1, i.e. perpendicularly to the second displacement direction D2. According to the embodiment of the invention shown in FIG. 2, the first and second engaging projections 36, 37 extend respectively perpendicularly from the first and second sides of the annular body 35.

As shown in FIGS. 3*a* to 3*d*, the first and second Oldham couplings 27, 28 are configured such that, in operation, the resulting center of gravity $CG_R$ of the first and second Oldham couplings 27, 28 is moving along a circular trajectory whose center is located on the rotation axis A of the drive shaft 24.

Figures 3A, 3B, 3C, 3D:
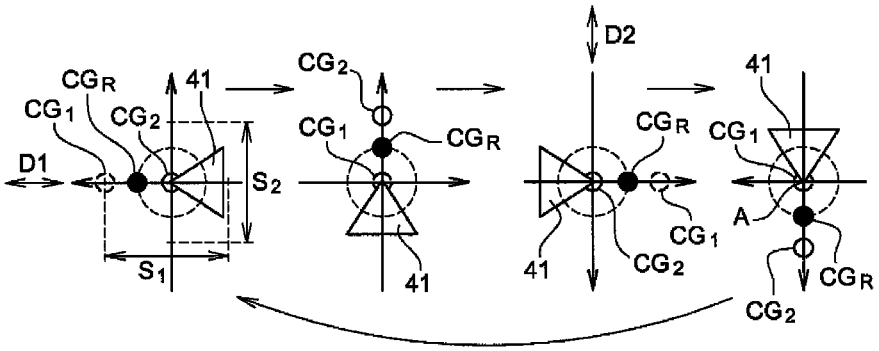
FIGS. 3*a*, 3*b*, 3*c* and 3*d* are schematic views of the two Oldham couplings of FIG. 2 in several operating positions.

Further, as shown in FIGS. 3*b* and 3*c*, the first and second Oldham couplings 27, 28 are configured such that the middle-stroke positions of the centers of gravity $CG_1$, $CG_2$ of the first and second Oldham couplings 27, 28 are located on the rotation axis A of the drive shaft 24. The stroke length S1 of the first Oldham coupling 27 along the first displacement direction D1 may be substantially equal to the stroke length S2 of the second Oldham coupling 28 along the second displacement direction D2.

The scroll refrigeration compressor 2 further comprises a rotating counterweight 41 attached to the drive shaft 24 and intended to balance on the one hand the total mass of the first and second Oldham couplings 27, 28, and on the other hand the mass of the orbiting scroll member 11. The center of gravity of the counterweight 41 is substantially diametrically opposed to the resulting center of gravity of the first and second Oldham couplings 27, 28 and of the orbiting scroll member 11 with respect to the rotation axis A of the drive shaft 24.

Figure 4:
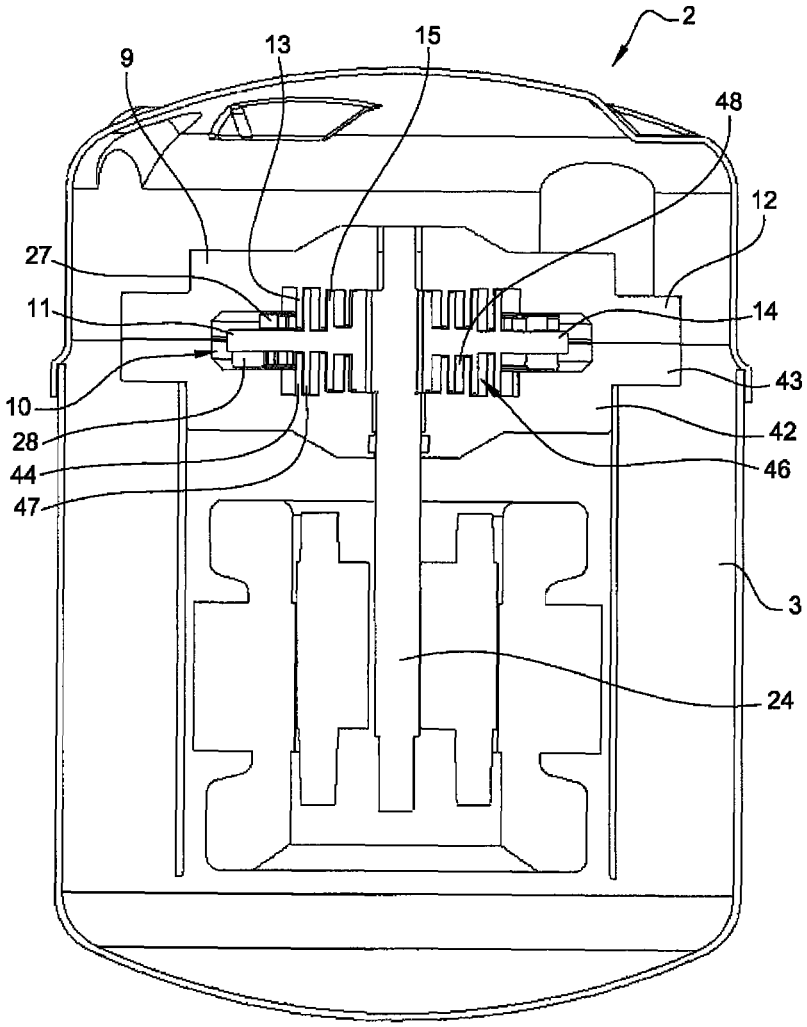
FIG. 4 is a longitudinal section view of a scroll compressor according to a second embodiment of the invention.
Figure 5:
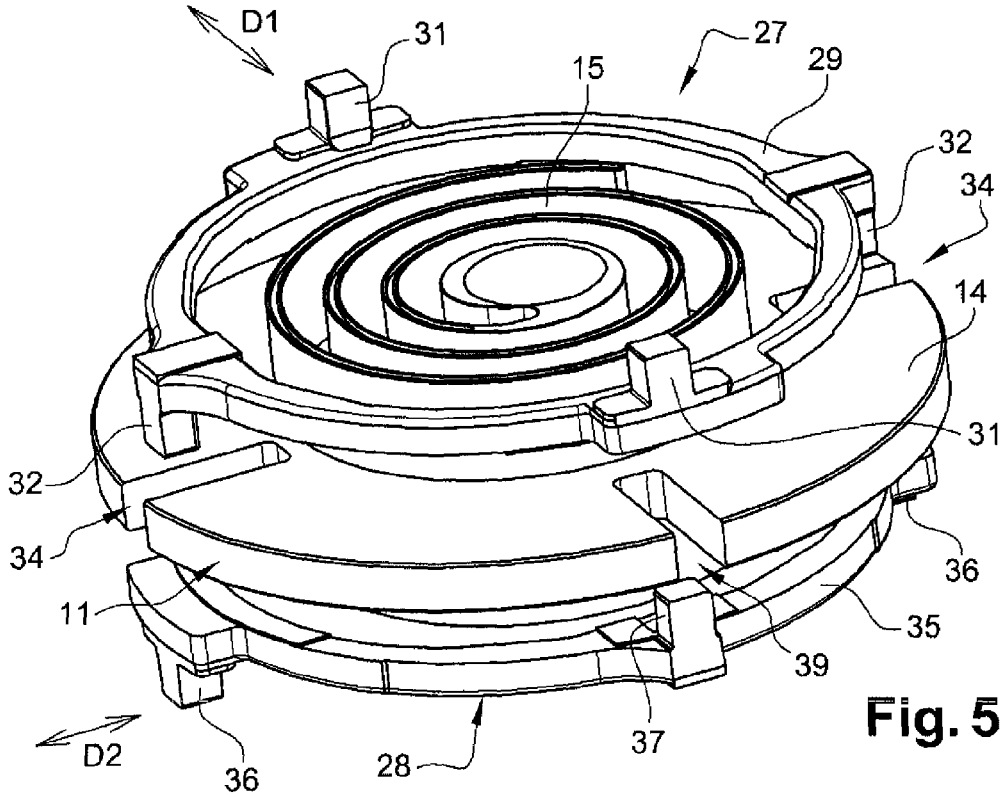
FIGS. 5 and 6 are perspective views respectively from above and below of two Oldham couplings and of an orbiting scroll arrangement of the scroll compressor of FIG. 4.
Figure 6:
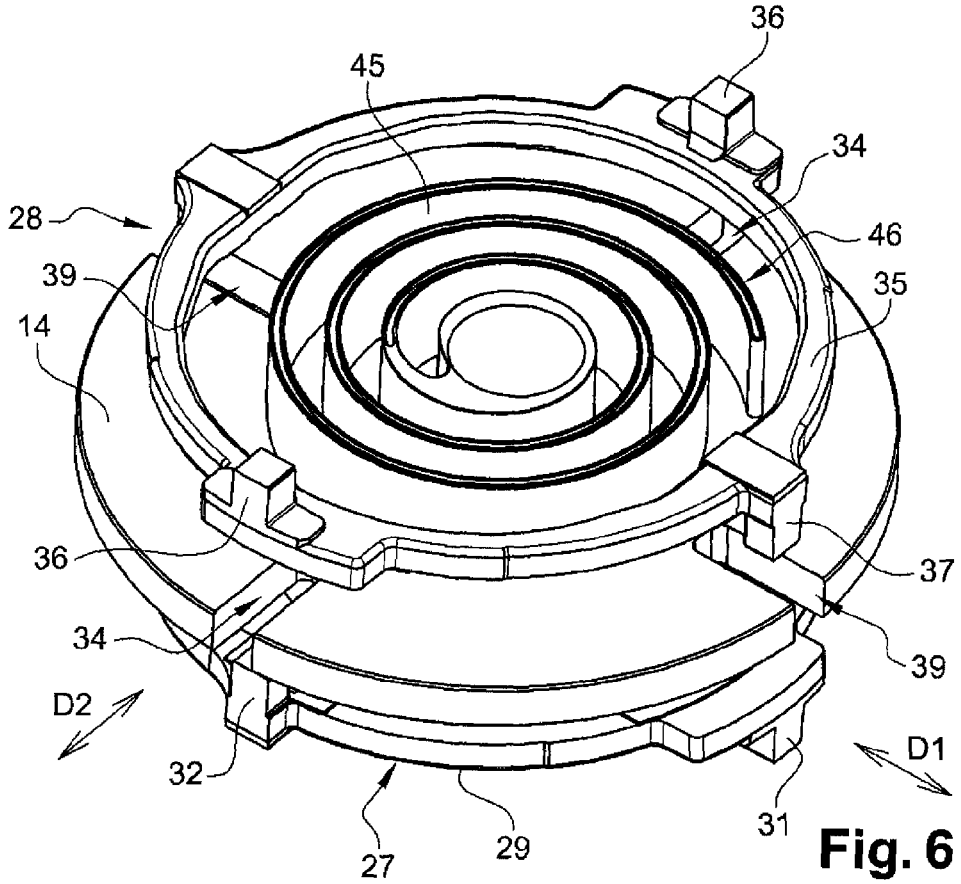

FIGS. 4 to 6 show a scroll refrigeration compressor 2 according to a second embodiment of the invention which differs from the one disclosed in FIGS. 1 and 2 essentially in that the support frame 7 is replaced with a second fixed scroll member 42 comprising an end plate 43 fixed for example to the end plate 12 of the fixed scroll member 9, and a spiral wrap 44 projecting from the end plate 43 towards the fixed scroll member 9, and in that the orbiting scroll arrangement 10 further includes a second orbiting scroll member 46. The orbiting scroll member 46 includes a spiral wrap 47 projecting from the end plate 14 towards the fixed scroll member 42, the spiral wrap 47 of the orbiting scroll member 46 meshing with the spiral wrap 44 of the fixed scroll member 42 to form a plurality of compression chambers 48 between them.

Thus, according to the second embodiment, the spiral wraps 15, 47 are provided on opposing faces of the end plate 14 of the orbiting scroll member 11. However, according to another embodiment of the invention, the orbiting scroll member 46 may include a separate end plate secured to the end plate 14 of the orbiting scroll member 11.

Further according to the second embodiment, the second Oldham coupling 28 is disposed between the end plate 14 of the orbiting scroll member 11 and the end plate 43 of the fixed scroll member 42, and around the spiral wraps 44, 47. Furthermore the first engaging projections 36 of the second Oldham coupling 28 are slidably engaged in a pair of guiding grooves provided on the end plate 43 of the fixed scroll member 42.

Of course, the invention is not restricted to the embodiments described above by way of non-limiting examples, but on the contrary it encompasses all embodiments thereof.

The invention claimed is:

1. A scroll compressor comprising:

a first fixed scroll member comprising a first fixed end plate and a first fixed spiral wrap provided on one face of the first fixed end plate, an orbiting scroll arrangement including at least a first orbiting scroll member comprising a first orbiting end plate and a first orbiting spiral wrap provided on one face of the first orbiting end plate, the first fixed spiral wrap and the first orbiting spiral wrap forming a plurality of first compression chambers, a first Oldham coupling provided between the first orbiting scroll member and the first fixed scroll member, and configured to prevent rotation of the first orbiting scroll member with respect to the first fixed scroll member, the first Oldham coupling being slidable with respect to the first fixed scroll member along a first displacement direction, a second Oldham coupling configured to prevent rotation of the orbiting scroll arrangement with respect to the first fixed scroll member, the second Oldham coupling being slidable with respect to the first fixed scroll member along a second displacement direction, wherein the first and second displacement directions of the first and second Oldham couplings are substantially orthogonal with respect to each other.

2. The scroll compressor according to claim 1, wherein the first and second Oldham couplings are configured such that, in operation, the resulting center of gravity of the first and second Oldham couplings is moving along a circular trajectory.

3. The scroll compressor according to claim 1, further comprising a drive shaft adapted for driving the orbiting scroll arrangement in an orbital movement, and a motor for driving in rotation the drive shaft about a rotation axis.

4. The scroll compressor according to claim 2, further comprising a driveshaft adapted for driving the orbiting scroll arrangement in an orbital movement, and a motor for driving in rotation the drive shaft about a rotation axis; wherein the center of the circular trajectory is substantially located on the axis of the drive shaft.

5. A scroll compressor according to claim 3, wherein the first and second Oldham couplings are configured such that the middle-stroke positions of the centers of gravity of the first and second Oldham couplings are substantially located on the rotation axis of the drive shaft.

6. The scroll compressor according to claim 3, further comprising a counterweight attached to the drive shaft and intended to balance the total mass of the first and second Oldham couplings.

7. The scroll compressor according to claim 4, further comprising a counterweight attached to the drive shaft and intended to balance the total mass of the first and second Oldham couplings, wherein the center of gravity of the counterweight is substantially diametrically opposed to the resulting center gravity of the first and second Oldham couplings with respect to the rotation axis of the drive shaft.

8. The scroll compressor according to claim 1, wherein a first stroke length of the first Oldham coupling along the first displacement direction is substantially equal to a second stroke length of the second Oldham coupling along the second displacement direction.

9. The scroll compressor according to claim 1, wherein the first Oldham coupling includes:

a first annular body, a first pair of first engaging projections provided on a first side of the first annular body, the first engaging projections of the first Oldham coupling being slidably engaged in a first pair of first guiding grooves provided on the first fixed scroll member, said first guiding grooves being offset and extending substantially parallel to the first displacement direction, and a second pair of second engaging projections provided on a second side of the first annular body, the second engaging projections of the first Oldham coupling being slidably engaged in a second pair of second guiding grooves provided on the first orbiting scroll member, said second guiding grooves being offset and extending substantially perpendicularly to the first displacement direction.

10. The scroll compressor according to claim 1, further comprising a fixed element opposite to the first fixed scroll member with respect to the orbiting scroll arrangement the second Oldham coupling being provided between the orbiting scroll arrangement and the fixed element and configured to prevent rotation of the orbiting scroll arrangement with respect to the fixed element, the second Oldham coupling being slidable with respect to the fixed element along the second displacement direction.

11. The scroll compressor according to claim 10, wherein the second Oldham coupling includes:

a second annular body, a first pair of first engaging projections provided on a first side of the second annular body, the first engaging projections of the second Oldham coupling being slidably engaged in a first pair of first guiding grooves provided on the fixed element, said first guiding grooves being offset and extending substantially parallel to the second displacement direction, and a second pair of second engaging projections provided on a second side of the second annular body, the second engaging projections of the second Oldham coupling being slidably engaged in a second pair of second guiding grooves provided on the orbiting scroll arrangement, said second guiding grooves being offset and extending substantially perpendicularly to the second displacement direction.

12. The scroll compressor according to claim 10, wherein the fixed element is formed by a support frame on which is slidably mounted the first orbiting end plate of the first orbiting scroll member.

13. The scroll compressor according to claim 10, wherein:

the fixed element is formed by a second fixed scroll member comprising a second fixed end plate and a second fixed spiral wrap provided on one face of the second fixed end plate, and the orbiting scroll arrangement further comprises a second orbiting scroll member comprising a second orbiting end plate and a second orbiting spiral wrap provided on one face of the second orbiting end plate, the second fixed spiral wrap and the second orbiting spiral wrap forming a plurality of second compression chambers, the second Oldham coupling being provided between the second orbiting scroll member and the second fixed scroll member.

14. The scroll compressor according to claim 13, wherein the first and second orbiting end plates are formed by a common end plate, the first and second orbiting spiral wraps being provided on opposing faces of the common end plate.

15. A method of operating a scroll compressor, comprising the steps of:

providing the scroll compressor with:

a first fixed scroll member comprising a first fixed end plate and a first fixed spiral wrap provided on one face of the first fixed end plate, an orbiting scroll arrangement including at least a first orbiting scroll member comprising a first orbiting end and a first orbiting spiral wrap provided on one face of the first orbiting end plate, the first fixed spiral wrap and the first orbiting spiral wrap forming a plurality of first compression chambers, a first Oldham coupling provided between the first orbiting scroll member and the first fixed scroll member, and configured to prevent rotation of the first orbiting scroll member with respect to the first fixed scroll member, the first Oldham coupling being slidable with respect to the first fixed scroll member along a first displacement direction a second Oldham coupling configured to prevent rotation of the orbiting scroll arrangement with respect to the first fixed scroll member, the second Oldham coupling being slidable with respect to the first fixed scroll member along a second displacement direction, the second displacement direction of the second Oldham coupling being substantially orthogonal to the first displacement direction of the first Oldham coupling, and displacing the orbiting scroll arrangement along an orbital movement so as to displace the first and second Oldham couplings respectively along the first and second displacement directions.

16. The method of claim 15, wherein the providing step further comprises providing the scroll compressor with:

a drive shaft adapted for driving the orbiting scroll arrangement in the orbital movement, and a motor for driving in rotation the drive shaft about a rotation axis, and the method further comprises the step of balancing the total mass of the first and second Oldham couplings with a counterweight.

* * * * *